United States Patent [19]

Elsbett et al.

[11] 4,103,663

[45] Aug. 1, 1978

[54] CYLINDER HEAD FOR INTERNAL COMBUSTION ENGINES, ESPECIALLY DIESEL ENGINES

[76] Inventors: Ludwig Elsbett; Günter Elsbett, both of Industriestr. 14, D8543 Hilpoltstein, Fed. Rep. of Germany

[21] Appl. No.: 741,351

[22] Filed: Nov. 12, 1976

[30] Foreign Application Priority Data

Nov. 12, 1975 [DE] Fed. Rep. of Germany ..... 2550781

[51] Int. Cl.[2] ..... F01L 3/00

[52] U.S. Cl. ..... 123/188 S; 123/188 M; 123/191 M; 251/363

[58] Field of Search ..... 123/188 R, 188 S, 188 M, 123/191 M, 193 H, 41.77; 251/360, 362, 363, 365; 277/329.01

[56] References Cited

U.S. PATENT DOCUMENTS

| | | | |
|---|---|---|---|
| 1,569,245 | 1/1926 | Willgoos | 123/188 S |
| 2,585,658 | 2/1952 | Keller | 251/363 |
| 2,665,675 | 1/1954 | Sheppard | 123/188 S |
| 2,696,810 | 12/1954 | Kuepfer | 251/362 |
| 3,046,965 | 7/1962 | Kauffmann et al. | 123/188 S |
| 3,115,127 | 12/1963 | Spencer | 123/188 S |
| 3,285,235 | 11/1966 | Veberschaer | 123/188 S |
| 4,011,852 | 3/1977 | Rasch | 123/188 S |

FOREIGN PATENT DOCUMENTS

| | | | |
|---|---|---|---|
| 771,443 | 10/1934 | France | 123/188 S |
| 744,250 | 5/1943 | Fed. Rep. of Germany | 123/188 S |

*Primary Examiner*—Charles J. Myhre
*Assistant Examiner*—David D. Reynolds
*Attorney, Agent, or Firm*—Walter Becker

[57] ABSTRACT

A cylinder head for internal combustion engines, especially Diesel engines, with at least one opening for a passage forming an inlet or outlet and leading to a combustion chamber. This opening which is adapted to be closed and opened by a valve is on that side thereof which faces in the direction toward the combustion chamber, provided with a valve seat ring fastened in the opening of the passage. Each valve seat ring is to its major extent conical with the basis of the cone pointing toward the combustion chamber while only that end of the valve seat ring which faces away from the combustion chamber is in a projecting manner fastened to the cylinder head.

14 Claims, 4 Drawing Figures

CYLINDER HEAD FOR INTERNAL COMBUSTION ENGINES, ESPECIALLY DIESEL ENGINES

The present invention relates to a cylinder head for internal combustion engines, especially diesel engines, with at least one opening for a passage leading into the combustion chamber and designed as an inlet or outlet passage. This opening is selectively adapted to be opened and to be closed by a valve, and the opening itself is at its respective side pointing toward the combustion chamber provided with a valve seat ring which is connected in the opening of the passage.

It is known to close the combustion chambers of internal combustion engines, such as diesel engines, among others, by cylinder heads and to provide in the cylinder heads inlet and outlet passages with corresponding closing elements for the fresh air and for the waste gases, and also to provide injection means for the fuel. These closing elements which, as a rule, may be designed as axially displaceable valves comprise a valve head and a valve shank which is guided in the cylinder head and is arranged adjacent the valve head. The valve head is actuated by actuating means in conformity with the cycle of the internal combustion engine. To be able to close the combustion chamber in a gas-tight manner with regard to the inlet and/or outlet passages, it is necessary that the sealing rim of the valve head on all sides closely engages the sealing rim of the inlet and/or outlet passages, which means sealingly engages the rim of the opening leading to the combustion chamber, so that gases or fuel-air mixtures cannot accidentally escape from the combustion chamber at these areas in spite of the enormous pressure prevailing in the combustion chamber, especially during a compression and combustion cycle. However, since it cannot be avoided that during the closing movement of the valves the valves hit the sealing rims of the inlet and outlet passages and thereby damage these areas, leakage and thus power losses of the internal combustion engine will result because cylinder heads with knocked off sealing areas or sealing rims can no longer withstand the high gas pressure. It is customary, in order to avoid such damages, to provide the inlet and outlet passages at their sealing areas relative to the combustion chamber with valve seat rings which after they have worn off are simply exchanged and which protect the cylinder head against further damage.

With a heretofore known cylinder head for internal combustion engines of the type involved, the passages leading into the combustion chamber for the inlet and outlet of the fuel/air mixture and the exhaust gases are at their openings leading into the combustion chamber provided with valve seat rings which are inserted into recesses of these passages. For the insertion, and in particular for the connection of these valve seat rings, sheet metal frames are provided which are arranged coaxially about a web of the cylinder head, the web being located between the respective passages. These sheet metal frames are cast into the cylinder head and the valve seat rings are connected thereto by welding or soldering. In order in this connection to enable a radial expansion of the sheet metal frames, the sheet metal frames are transversely divided and this transverse division is covered by the valve seat rings extending thereover for purposes of obtaining a seal. While with such a design of the cylinder head not only high costs are involved when casting the cylinder head, it must also not be overlooked that, on the one hand, the connection of the valve seat rings to the sheet metal frame is time consuming and expensive and that, on the other hand, the webs located between the valve seat rings are hardly protected by these valve seat rings against any damage caused by the alternating temperature changes due to cooling and heating during the working cycle of the internal combustion engine (see German Pat. No. 1,001,860).

To counteract such damages to the webs located between the valve seat rings of the internal combustion engine, it us further known to produce the valve seat rings for each two adjacent inlet and outlet passages from one single piece and to arrange that section which interconnects the valve seat rings as a shield over the respective web. While by such a construction of the valve seat rings the webs will be protected against overheating, it can nevertheless happen that, due to the enormous especially mechanical stresses to which the valve seat rings are subjected, not only tears will occur in the valve seat rings but that the valve seat rings in their entirety will be knocked out of their position. A damage of this kind can have serious consequences so that such valve seat rings are not able reliably to meet the respective requirements.

To avoid the above mentioned drawbacks, it has been suggested to provide the valve seat rings of adjacent inlet and outlet passages of the internal combustion engines involved, such as diesel engines, at those sides thereof which face each other with a flattened area of the otherwise cylindrical-concentric or eccentric mantle and to continue this flattened area over the entire thickness of the valve seat ring in such a way that the flattened areas planely engage each other. Due to this mutual engagement of the valve seat rings, a common shield is formed by means of which the web located between the valve seat rings can be protected against heat effects. The connection of the valve seat rings themselves at the openings of the inlet and outlet passages leading into the combustion chamber is effected by pressing-in the valve seat rings which are furnished oversized and undercooled so that with a corresponding tempering these valve seat rings will frictionally engage recesses of the openings which recesses are provided for this purpose. This design of the valve seat rings, in addition to offering protection of the respective web located between the valve seat rings, also brings about the advantage of a simplified manufacturing process. However, with high load internal combustion engines it is frequently necessary that the valve seat rings are able to meet further alternating thermal requirements.

It is at this point that the present invention starts. More specifically, it is an object of the present invention to improve a cylinder head for internal combustion engines in such a way that, in addition to protecting the web located between the valve seat rings, it will be possible to insert the valve seat rings not only possibly without oversize into the recesses provided therefor at the openings of the inlet and outlet passages and in spite of the alternating heat and pressure effects without either being knocked out or materially deformed, but that the valve seat rings will also be able to adapt themselves to the alternating, especially thermal stresses.

These and other objects and advantages of the invention will appear more clearly from the following specification in connection with the accompanying drawing, in which.

Figure 1:
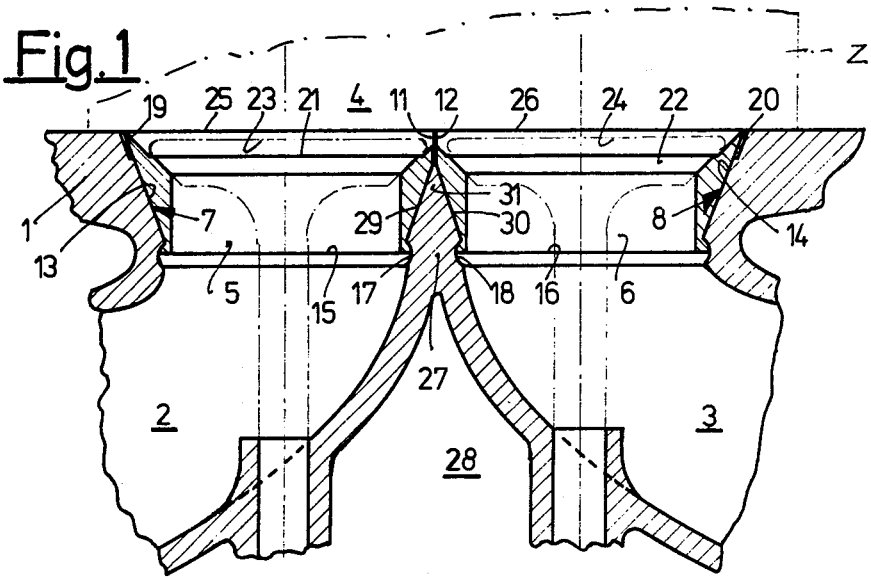
FIG. 1 illustrates a longitudinal central section through a cylinder head with valve seat rings according to the invention inserted into the inlet and outlet passages of the cylinder head.

The problem underlying the present invention has been solved according to the present invention by the fact that each valve seat ring is designed primarily conically with the base of the cone pointing toward the combustion chamber, while the valve seat ring is only at that end thereof which faces away from the combustion chamber in a projecting manner connected to the cylinder head. In view of these features, the problem underlying the present invention has been advantageously solved and in addition thereto the cylinder head including its valve seat rings can be produced in a very simple manner.

By the now possible effective covering of the web between the valve seat rings and the expansion active connection of the valve seat rings in the recess at the openings of the cylinder head, it is possible with simple means to provide a shield which adapts itself to a great extent especially to the changing thermal stresses of the internal combustion engine and in addition thereto forms an effective seal so that also the heat losses of the internal combustion chamber, especially during the working cycles, are prevented to a major extent. In addition thereto it may be pointed out that the connection of the respective valve seat ring to the cylinder head is possible by a simple rolling-in of the rim of the valve seat ring at the recesses which rim faces away from the combustion chamber. This operation is not only simple to carry out but can also be effected in a time saving manner.

Due to the projecting connection of each valve seat ring, the valve seat ring will have the possibility to adapt itself easier to the changing loads, especially thermal loads, of the internal combustion engine because the axial expansion of the valve seat ring and thus a movement of the latter on the walls of the recess in view of radial expansion of the valve seat ring due to pressure and heat effects is not excluded.

A further advantageous development of a cylinder head with a valve seat ring in an opening of the inlet as well as the outlet passage and with a web located between the openings and separating the passages from each other may consist in that each valve seat ring by means of its mantle surface shields with regard to the combustion chamber at least one portion of the web located between the openings of the inlet and/or outlet passage.

These features bring about the advantage that the web is hardly subjected to the thermal stresses which continuously vary so that tears will no longer form in the web. Heretofore web tears were almost always unavoidable and brought about considerable damage to the internal combustion engine.

The expansion of each valve seat ring, especially in axial direction, is facilitated further by the feature that that section of the mantle surface of each valve seat ring which is located between the valve seat surface and a connection and that also the mantle surface of the web facing the valve seat rings are designed conically with the inclinations of the cones being adapted to each other.

These features will assure that the respective valve seat ring will be able to expand axially when a corresponding thermal load is acting thereupon so that the valve seat ring while ascending on the inclination of its seat can escape also radially. Consequently stresses in the valve seat ring will be avoided and the danger that tears will occur will be eliminated.

In special instances it is possible in conformity with the present invention that each valve seat ring has a heat accumulation between the valve seat ring and the mantle surfaces at the openings of the inlet and/or outlet passages. As a result of this feature the thermal stresses acting upon the valve seat ring cannot materially be conveyed to the cylinder head whereby the latter will no longer be subjected to such strong stresses as was heretofore common.

Referring now to the drawing in detail, the structure shown therein comprises a cylinder head 1 with inlet and outlet passages 2, 3 for each combustion chamber 4 of an internal combustion engine, the combustion chambers being respectively provided in cylinders indicated by dot-dash lines only and designated Z. The inlet and outlet passage of the combustion chamber 4 are at those openings thereof which face the combustion chamber provided with valve seat rings 5, 6. The valve seat rings 5, 6 are preferably inserted in recesses 7, 8 which face the combustion chamber 4. The arrangement of the valve seat rings 5, 6 is such that a valve seat ring 5 of the inlet passage 2 is located opposite a valve seat ring 6 of the outer passage 3. The valve seat rings 5, 6 which in the specific showing (see in particular FIG. 2) have a cylindrical shape are at those mantle surfaces 9, 10 thereof which face each other respectively provided with a flattened portion 11, 12. These flattened portions are so designed that the valve seat rings have their flattened portions planely engaging each other. To this end, the mantle surfaces 9, 10 of the valve seat rings 5, 6 are at the flattened portions 11, 12 provided with vertical mantle surfaces, whereas the mantle surfaces on the remaining circumference are conical. The diameter of the conical shape of the mantle surfaces 9, 10 of each seat ring 5, 6 decreases steadily from the combustion chamber 4, the so-called hot portion, to the inlet and outlet passages 2, 3 proper, the so-called cold portion. Also the mantle surfaces 13, 14 of the recesses 4, 8 follow the conical mantle surfaces 9, 10 of the valve seat rings 5, 6.

The inclinations of the mantle surfaces 13, 14 at the recesses 7, 8 as well as the mantle surfaces 9, 10 of the valve seat rings 5, 6 are so selected that the valve seat rings, due to thermal and/ or mechanical stresses, will not jam because of self-locking action at the mantle surfaces 13, 14 of the recesses but will be able to slide along these mantle surfaces. In order to make sure that the valve seat rings 5, 6 will be able to slide along the mantle surfaces 13, 14 of the recesses 7, 8, the valve seat rings are only with their rims 15, 16 which face away from the combustion chamber 4, i.e. the rim, connected to the so-called cold portion in the recesses 7, 8 of the openings of the inlet and outlet passages 2, 3. The connection of the rims 15, 16 of the respective valve seat ring 5, 6 can preferably be effected by rolling-in the rim into a notch 17, 18 of the recess 7, 8 respectively. In view of this connection of each valve seat ring 5, 6 to the so-called cold portion, i.e. the rim 15, 16 which faces away from the combustion chamber 4, each valve seat ring is able in conformity with the thermal and/or mechanical load within predetermined limits which do not affect the function of the valve seat rings to expand axially in the direction toward the combustion chamber 4 and away therefrom and thus also radially, which means transverse to this direction, and is furthermore able to shrink back again whereby stresses in the respective valve seat ring will be avoided which stresses frequently bring about a knocking out or breaking of the valve seat ring.

In order to meet a frequently occurring requirement for a better combustion of the fuel-air components in a combustion chamber 4 while only small quantities of harmful exhaust gas emissions are formed, it is provided with this cylinder head 1 to arrange the valve seat rings 5, 6 in a heat insulating or accumulating manner opposite the walls of the recesses 7, 8 at the openings of the inlet and outlet passages 2, 3. Such a heat accumulation may be effected, for instance, by an air gap 19, 20 or other heat insulating means, such as ceramic inserts, carbon, and the like, which in such an instance are provided between the respective valve seat rings 5, 6 and the mantle surfaces 13, 14 of the recesses 7, 8. Tests with valve seat rings 5, 6 of this type have proved that usually it is sufficient when the heat insulation or heat accumulation, for instance the air gap 19, 20, is provided between the valve seat ring and the mantle surface 13, 14 of the recess 7, 8 only within the region of a sealing rim 21, 22 of a valve 23, 24 which opens or closes the inlet or outlet passage 2, 3 and which is indicated in the drawing only by dot-dash lines. In such an instance it will suffice when this region for the dimensioning of the band width of the heat accumulation extends from the sealing rim 21, 22 of the valve seat ring 5, 6 to a rim 25, 26 of the valve seat ring which ring faces the combustion chamber 4. This is illustrated in the embodiment of FIG. 1. In order by means of such valve seat ring 5, 6 to be able also to protect a web 27 of the cylinder head 1, which web is located between the inlet and outlet passages 2, 3, against overheating by the changing thermal load of the internal combustion engine, the valve seat rings 5, 6 with their flattened portions 11, 12 are extended over the web so that the valve seat rings form a shield for the otherwise endangered web.

The web 27 itself which is often provided with passages 21 for a cooling substance to cool the web, is within the region of the flattened portions 11, 12 likewise provided with conical mantle surfaces 29, 30 while the base of the cone of the last mentioned mantle surfaces faces away from the combustion chamber 4. On these conical mantle surfaces 29, 30 of the web 27 there are entirely or partially seated the valve seat rings 5, 6 whereby the valve seat rings are held also by the web itself. In order to make sure that the valve seat rings 5, 6 are also held on the web 27, those rims 15, 16 of the rings 5, 6 which face away from the combustion chamber 4 are rolled-in into the same notches 17, 18 which extend over the web. With this arrangement, the web 27 is conical, and the tip 31 of web 27 projects far between the valve seat rings 5, 6. Tests have shown that such configuration of the web 27 is advantageous with regard to the protection of the web as well as with regard to the seating of the valve seat rings 5, 6.

The invention, however, also comprises an arrangement according to which the web 27 is shorter and also comprises an arrangement according to which the respective adjacent flattened portions 11, 12 of the valve seat rings 5, 6 are wider.

Figure 2:
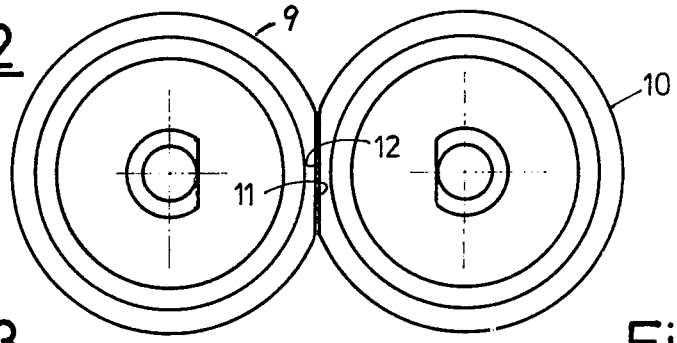
FIG. 2 illustrates a top view of two valve seat rings and shows a portion of the cylinder head of FIG. 1.
Figure 3:
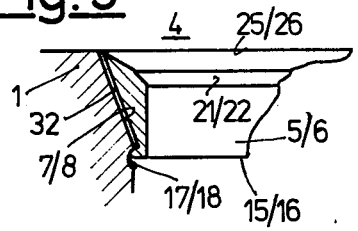
FIG. 3 illustrates a longitudinal section through an inlet or outlet passage having a valve seat ring according to the invention arranged therein and being heat insulated to a major extent.

The embodiment of the valve seat rings 5, 6 according to FIG. 3 is based on the same findings as the embodiment of FIGS. 1 and 2 and differs therefrom only by longer heat accumulating means which for the sake of simplicity have likewise been shown as an air gap 32. The air gap 32 is in this instance extended from the combustion chamber 4 to the notch 17, 18 of the cylinder head 1. Furthermore, the valve seat ring 5, 6 rests only through its rolled-in portion or the rim 15, 16 thereof on the recess 7, 8 and thus on the cylinder head 1. Also with this embodiment, the valve seat rings 5, 6 can due to the fact they are at one end clamped-in in a projecting manner on the cylinder head 1, freely expand axially as well as radially within the predetermined limits.

Figure 4:
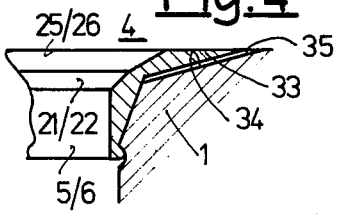
FIG. 4 is a longitudinal section through an inlet or outlet passage having a valve seat ring according to the invention arranged therein and being heat insulated and provided with a broadened section.

Also the further embodiment shown in FIG. 4 is based on the fundamental findings with the embodiment according to FIGS. 1 and 2 and differs therefrom primarily by a shield-like broadened portion 33 of the rim 25, 26 of each valve seat ring 5, 6 which rim is exposed to the combustion chamber 4. In view of this shield-like broadened portion 33 which for a combustion chamber 4 may have nearly random extension, i.e. diameter, it is possible with simple means to protect the cylinder head 1 especially against heat effects, particularly since this broadened portion 33 may be designed so as to accumulate or store heat with regard to the cylinder head. The heat accumulation of this broadened portion 33 is similar to the heat accumulating portions of the above mentioned examples designed for the sake of simplicity likewise as air gap 34. The broadened portion 33 may, if required by the construction of the internal combustion engine, also be so designed that it is adapted to the entire diameter of the combustion chamber 4 so that the cylinder head 1 will by means of the broadened portion 33 be protected against heat and cavitation effects. In such an instance, the broadened portion 33 acts like a shield in front of the cylinder head 1 and keeps away therefrom all outer influences. The broadened portion 33 may preferably be inserted in a recess 35 of the cylinder head 1.

The illustrated and above described embodiments of the valve seat rings 5, 6 are based primarily on cylindrical rings with a centric center. However, it is also possible to design the valve seat rings 5, 6 eccentrically; in such an instance it may be advantageous when the wider rim between the respective outer mantle surface 9, 10 and the sealing rim 21, 22 faces the flattened portions 11, 12. It is also possible to provide a plurality of valve seat rings 5, 6 for one combustion chamber 4, and to equip those sides of the valve seat rings 5, 6 which face each other with the above mentioned flattened portions 11, 12.

The cylinder head 1 and the valve seat rings 5, 6 mounted thereon have been described in particular in connection with an internal combustion engine working in conformity with the diesel principle. This, however, does not exclude to provide such valve seat rings 5, 6 on cylinder heads 1 of internal combustion engines working in conformity with the Otto principle. As to the inclinations on the mantle surfaces 9, 10; 13, 14 and 29,

30, these inclinations can be adapted to the prevailing requirements while it has merely to be borne in mind that these inclinations must be so designed that the valve seat rings 5, 6 can slide along the mantle surface. Tests with valve seat rings 5, 6 of this type have shown that an inclination of about 20° is very satisfactory for such sliding action.

It is, of course, to be understood that the present invention is, by no means, limited to the specific showing in the drawing but also comprises any modifications within the scope of the appended claims.

What we claim is:

1. A cylinder head for internal combustion engines, especially Diesel engines, which includes wall means defining passage means and a mouth section therefor for communication with a combustion chamber, said mouth section comprising an inner portion and an outer portion and a conical surface flaring outwardly from said inner portion to said outer portion, and valve seating ring means having an outer peripheral surface substantially parallel to and adjacent said conical surface, while projecting over the latter, said valve seating ring means being connected to said inner portion only of said mouth section and having its inner peripheral surface provided with a valve seating area, thermal insulation means between the outer peripheral surface of said valve seating ring means and the adjacent surface of said mouth section, said thermal insulation means between said valve seating ring means and the wall means of said mouth section being provided only within the region of said valve seating area and that rim portion of the respective valve seating ring means which is remote from said inner mouth portion.

2. A cylinder according to claim 1 in which said thermal insulation means is formed by an air gap.

3. A cylinder head for internal combustion engines, especially Diesel engines, which includes wall means defining passage means and a mouth section therefor for communication with a combustion chamber, said mouth section comprising an inner portion and an outer portion and a conical surface flaring outwardly from said inner portion to said outer portion, sand valve seating ring means having an outer peripheral surface substantially parallel to and adjacent said conical surface, while projecting over the latter, said valve seating ring means being connected to said inner portion only of said mouth section and having its inner peripheral surface provided with a valve seating area, thermal insulation means between the outer peripheral surface of said valve seating ring means and the adjacent surface of said mouth section, extending from that rim of said valve seating ring means which is remote from the inner mouth portion up to that rim portion of the same valve seating ring means which is connected to said inner mouth portion.

4. A cylinder head for internal combustion engines, especially Diesel engines, which includes wall means defining passage means and a mouth section therefor for communication with a combustion chamber, said mouth section comprising an inner portion and an outer portion and a conical surface flaring outwardly from said inner portion to said outer portion, and valve seating ring means having an outer peripheral surface substantially parallel to and adjacent said conical surface, while projecting over the latter, said valve seating ring means being connected to said inner portion only of said mouth section and having its inner peripheral surface provided with a valve seating area, each valve seating ring means having that rim portion thereof which is remote from said inner mouth portion provided with a shield-like broadening section extending radially from said last mentioned rim portion.

5. A cylinder head according to claim 4, in which said passage means include an inlet passage and an outlet passage, and in which said valve seating ring means includes a first valve seating ring arranged in said inlet passage and also includes a second valve seating ring arranged in said outlet passage, and web means forming a part of said wall means and extending between said valve seating ring means while being shielded thereby.

6. A cylinder heat according to claim 5, in which that rim portion of said first and second valve seating rings which is remote from said inner portion of said mouth section projects beyond said web means in a direction away from said inner portion, said projecting rim portions adjacent said web comprising substantially flat surfaces engaging each other.

7. A cylinder according to claim 5, in which said web means has those surfaces thereof which are in engagement with said valve seating rings inclined complementary to each other.

8. A cylinder according to claim 4, which includes thermal insulation means between the outer peripheral surface of said valve seating ring means and the adjacent surface of said mouth section.

9. A cylinder according to claim 4, in which said inner portion is provided with annular groove means, and in which each of said valve seating ring means has its rim portion which is adjacent said groove means rolled into the latter.

10. A cylinder according to claim 7, in which the surfaces of said seating rings and the surfaces of said web engaging the surfaces of said seating ring and also said conical mouth surface and the surface of the valve seating rings engaged thereby have such an inclination as to prevent a self-locking action of said valve seating rings.

11. A cylinder according to claim 4, in which said broadening section is designed conically and in which the shorter diameter area of said conically broadening section is located within the region of said valve seating area.

12. A cylinder according to claim 4, which includes thermal insulation means between said broadening section and the adjacent surface of said cylinder head.

13. A cylinder according to claim 11, in which said broadening section forms an integral part with the respective adjacent valve seating ring, and in which the outer diameter of said broadening section is considerably greater than the outer diameter of the remaining portion of the valve seating ring means.

14. A cylinder according to claim 13, in which the outer mouth portion of said cylinder head has that surface thereof which faces away from the inner mouth portion provided with recess means receiving said broadening section.

* * * * *